US007458426B2

(12) United States Patent
Arai et al.

(10) Patent No.: US 7,458,426 B2
(45) Date of Patent: Dec. 2, 2008

(54) STEEL PIPE FOR EMBEDDING-EXPANDING, AND METHOD OF EMBEDDING-EXPANDING OIL WELL STEEL PIPE

(75) Inventors: Yuji Arai, Amagasaki (JP); Kunio Kondo, Sanda (JP); Hisashi Amaya, Kyoto (JP); Akihito Yamane, Amagasaki (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 1 day.

(21) Appl. No.: 11/790,874

(22) Filed: Apr. 27, 2007

(65) Prior Publication Data

US 2007/0199720 A1 Aug. 30, 2007

Related U.S. Application Data

(60) Division of application No. 10/651,941, filed on Sep. 2, 2003, now Pat. No. 7,225,868, which is a continuation of application No. PCT/JP02/02261, filed on Mar. 11, 2002.

(30) Foreign Application Priority Data

Mar. 9, 2001 (JP) ..... 2001-066141

(51) Int. Cl.
*E21B 43/10* (2006.01)
*E21B 29/00* (2006.01)
*C22C 38/00* (2006.01)

(52) U.S. Cl. ..... 166/380; 166/277; 166/207; 148/320

(58) Field of Classification Search ..... 166/297, 166/206, 207, 378, 55, 277, 384, 380; 175/57, 175/171; 148/320; 428/34.1, 573, 600; 138/118, 138/139

See application file for complete search history.

(56) References Cited

U.S. PATENT DOCUMENTS

| | | | | |
|---|---|---|---|---|
| 1,880,218 A | | 10/1932 | Simmons | |
| 4,332,073 A | * | 6/1982 | Yoshida et al. | 29/421.1 |
| 4,483,399 A | | 11/1984 | Colgate | |
| 4,795,078 A | | 1/1989 | Kuroki et al. | |
| 4,975,309 A | | 12/1990 | Gord et al. | |

(Continued)

FOREIGN PATENT DOCUMENTS

CA 2292171 12/1999

(Continued)

*Primary Examiner*—Shane Bomar
(74) *Attorney, Agent, or Firm*—Clark & Brody

(57) ABSTRACT

(1) A steel pipe that is expanded radially in a state wherein it was inserted in a well such as an oil well, characterized in that the non-uniform wall thickness ratio E0 (%) before expanding satisfies the following expression ①.

$$E0 \leq 30/(1+0.018\alpha) \quad ①$$

Wherein α is the pipe expansion ratio (%) calculated by the following expression ②.

$$\alpha = [(\text{inner diameter of the pipe after expanding} - \text{inner diameter of the pipe before expanding})/\text{inner diameter of the pipe before expanding}] \times 100 \quad ②$$

(2) A steel pipe that should be expanded radially in a state wherein it is inserted in a well, such as an oil well, characterized in that the eccentric non-uniform wall thickness ratio is 10% or less.

When the embedding-expanding method is performed with use of the steel pipe of (1) or (2), lowering of collapse strength of the expanded steel pipe is prevented and bending thereof can be decreased.

5 Claims, 6 Drawing Sheets

U.S. PATENT DOCUMENTS

| | | | | |
|---|---|---|---|---|
| 6,378,760 | B1 | 4/2002 | Shimizu et al. | |
| 6,457,518 | B1 * | 10/2002 | Castano-Mears et al. | 166/207 |
| 6,532,995 | B1 | 3/2003 | Asahi et al. | |
| 6,581,431 | B2 | 6/2003 | Vrubl et al. | |
| 6,632,296 | B2 | 10/2003 | Yoshinaga et al. | |
| 6,640,903 | B1 | 11/2003 | Cook et al. | |
| 6,742,606 | B2 | 6/2004 | Metcalfe et al. | |
| 6,770,016 | B1 | 8/2004 | Anderson et al. | |
| 6,782,921 | B1 | 8/2004 | Tsuru et al. | |
| 2003/0178472 | A1 * | 9/2003 | Gendron | 228/165 |
| 2003/0196734 | A1 * | 10/2003 | Ogawa | 148/590 |
| 2004/0234027 | A1 | 11/2004 | Olesen et al. | |
| 2005/0116392 | A1 * | 6/2005 | Vesci et al. | 264/611 |

FOREIGN PATENT DOCUMENTS

| | | |
|---|---|---|
| WO | WO93/25799 | 12/1993 |
| WO | WO98/00626 | 1/1998 |
| WO | WO99/35368 | 7/1999 |
| WO | WO99/55999 | 11/1999 |

* cited by examiner

PRIOR ART (a)

| Cycle | 360° | 180° | 120° | 90° | 60° |
|---|---|---|---|---|---|
| Definition | First Order of the Non-uniform Wall Thickness (Eccentric Non-uniform Wall Thickness) | Second Order of the Non-uniform Wall Thickness | Third Order of the Non-uniform Wall Thickness | Fourth Order of the Non-uniform Wall Thickness | Sixth Order of the Non-uniform Wall Thickness |
| Profile |  |  |  |  |  |

STEEL PIPE FOR EMBEDDING-EXPANDING, AND METHOD OF EMBEDDING-EXPANDING OIL WELL STEEL PIPE

This is a divisional of U.S. patent application Ser. No. 10/651,941 filed Sep. 2, 2003 now U.S. Pat. No. 7,225,868, which is a continuation of International Patent Application No. PCT/JP02/02261, filed Mar. 11, 2002. The PCT application was not in English as published under PCT Article 21(2).

TECHNICAL FIELD

The present invention relates to a steel pipe, which is embedded in an oil well or a gas well, which is collectively referred to as only an "oil well" hereinafter, and a method of embedding oil well steel pipes.

BACKGROUND ART

When oil well pipes are embedded from the surface of the earth to an underground oil field, excavation is first performed to provide a well having a predetermined depth and then an oil well pipe, which is called "casing", is embedded in the well in order to prevent the wall of the well from crumbling. Further excavation is performed from the front end of the casing to produce a deeper well, and then a new pipe for casing is embedded through the previously embedded casing. By repeating such operations, pipes, which are used in an oil field, are finally embedded.

FIG. 1 is a view for explaining the conventional method of embedding oil well pipes. In the conventional method, as shown in FIG. 1, a well having a larger diameter than that of a casing 1*a* is first excavated from the surface of earth 6 to a depth H1, then the casing 1*a* is embedded. Then the ground on the front end of the casing 1*a* is excavated to a depth H2 and another casing 1*b* is inserted. In this manner, a casing 1*c* and a casing 1*d* are embedded in sequence and a pipe called "tubing" 2, through which oil and gas are produced, is finally embedded.

In this case, since the diameter of the pipe, i.e., the tubing 2, through which oil and gas are produced, is predetermined, various kinds of pipes for casings having different diameters are necessary in proportion to the depth of the well. This is because, in inserting a casing coaxially into the previously embedded casing, a certain extent of clearance C between the inner diameter of the previously embedded casing and the outer diameter of the casing to be subsequently inserted is required, since shape failures such as the bending of steel pipes should be considered. Therefore, in order to excavate a deep well for embedding oil well pipes, the excavating area must be increased, resulting in increased cost for excavation.

Recently, in order to reduce the well excavation cost, a method of expanding pipes, after the embedding of oil well pipes in the ground, the inner diameter of the pipes are uniformly enlarged, has been proposed (Toku-Hyo-Hei.7-507610). Further, in International Laid-open Publication WO 098/00626, a method of expanding a pipe made of a malleable strain hardening steel, which does not generate necking or ductile fracture, is inserted into a previously embedded casing and the casing is expanded by use of a mandrel which has a tapered surface consisting of a nonmetallic material has been disclosed.

FIG. 2 is a view for explaining an embedding method comprising a step of pipe expanding. In this method, as shown in FIG. 2, a steel pipe 1 is inserted in an excavated well and the front end of the steel pipe 1 is then excavated to deepen the well in order to insert a steel pipe 3 in the embedded steel pipe 1. Then, a tool 4 inserted in the steel pipe 3 is raised by oil pressure, for example, from a lower portion of the steel pipe 3 to radially expand it. By repeating these operations a steel pipe 2, i.e., the tubing for oil or gas production is finally embedded.

FIG. 3 is a view showing a state where the pipe 2 is embedded by the pipe expanding method. By using the embedding-expanding method, a clearance between steel pipes can be decreased after embedding the pipes, as shown in FIG. 3. Accordingly, the excavating area can be smaller and the excavating costs can be significantly reduced.

However, the above-mentioned embedding-expanding method has the following problems. One of the problems is that the embedded and expanded steel pipe has remarkably lowered collapse resistance to the external pressure in the ground. This means lowering of its collapse strength. Another problem is that the expanded pipe generates bending.

Non-uniformity of the wall thickness exists unavoidably in the steel pipe. The non-uniformity of the wall thickness means non-uniformity of the wall thickness in the cross-section of the pipe. When a steel pipe, having non-uniformity of the wall thickness, is expanded, the thin wall thickness portion are subjected to a larger working ratio than the thick wall thickness portion, so that the non-uniformity of the wall thickness ratio becomes larger. This phenomenon leads to a decrease in collapse strength. Further, the thick wall portion and the thin wall portion of the pipe generate different amounts of expansion in the circumferential direction of the pipe during the expanding process, resulting in different amounts of shrinkage in the longitudinal direction of the pipe. Accordingly, the steel pipe is bent. When a casing or tubing is bent, non-uniform stress is applied to a screwed portion, which is the joint portion between pipes, so that gas may leak.

From the above-mentioned reasons, when the new technology, which is the embedding-expanding method is introduced, a steel pipe having small bending properties, in which collapse strength is not lowered even if the pipe is expanded, is required.

DISCLOSURE OF INVENTION

The first objective of the present invention is to provide a steel pipe, which has a small reduction in collapse strength, even if it is expanded radially when it was inserted into a well. More specifically the first objective of the present invention is to provide a steel pipe whose measured collapse strength (C1), after expanding it as an actual oil well pipe, is not less than 0.8, namely C1/C0≧0.8, wherein the collapse strength (C0), after expanding the pipe without a non-uniform wall thickness, is defined as 1.

The second objective of the present invention is to provide a steel pipe, which rarely bends, even if the pipe is expanded when it is inserted into a well.

The third objective of the present invention is to provide a method of embedding oil well pipes using the above-mentioned steel pipe.

The present inventors have investigated the cause of lowering the collapse strength and the cause of generating bending when the steel pipe is expanded after it is embedded. As a result the following knowledge has been found.

a) When a steel pipe, having a non-uniform wall thickness is expanded, the non-uniformity of the wall thickness increases further. The increase of the non-uniformity of the wall thickness causes the lowering of the collapse strength of the pipe. This reason for this is that the wall thickness of the pipe is reduced by the stretching of the pipe in a circumferential direction due to the expanding of the pipe, so that the thin wall portion of the pipe becomes thinner.

b) If the steel pipe has a non-uniform wall thickness ratio E0 before expanding and satisfies the following expression ①, the lowering of the collapse strength of the expanded pipe is not serious.

$$E0 \leqq 30/(1+0.018\alpha) \quad ①$$

Wherein α is a pipe expansion ratio (%) calculated by the following expression ②.

α=[(inner diameter of the pipe after expanding−inner diameter of the pipe before expanding)/inner diameter of the pipe before expanding]×100 ②

E0 is a non-uniform thickness ratio of the pipe before expanding calculated by the following expression ③.

*E*0=[(maximum wall thickness of the pipe before expanding−minimum wall thickness of the pipe before expanding)/average wall thickness of the pipe before expanding]×100 ③

The non-uniform wall thickness ratio E1 (%) of the pipe after expanding is calculated by the following expression ④.

*E*1=[(maximum wall thickness of the pipe after expanding−minimum wall thickness of the pipe after expanding)/average wall thickness of the pipe after expanding]×100 ④ c) When the expanding work is performed, bending occurs in a steel pipe due to the original non-uniform thickness of the pipe wall. When the pipe is stretched in the circumferential direction due to expanding, the thin wall portion is elongated more than the thick wall portion. Thus, the length in the thin wall portion is significantly reduced more than the thick wall portion. This phenomenon causes the bending of the pipe. In order to reduce the bending of the pipe due to expansion, it is important to reduce not only the non-uniform wall thickness ratio but also the eccentric non-uniform wall thickness described hereinafter.

The present invention is based on the above-mentioned knowledge. The gist of the invention is the steel pipes mentioned in the following (1) and (2), and a method of embedding steel pipes mentioned in the following (3).

(1) A steel pipe, which could be expanded radially after being embedded in a well, characterized in that the non-uniform wall thickness ratio E0 (%) before expanding satisfies the following expression ①.

$$E0 \leqq 30/(1+0.018\alpha) \quad ①$$

Wherein α is the pipe expansion ratio (%) calculated by the expression ②.

(2) A steel pipe, which could be expanded radially after being embedded in a well, characterized in that the eccentric non-uniform wall thickness ratio is 10% or less.

Further, the steel pipe of said (1) or (2) is preferably any steel pipe having the following chemical composition defined in (a), (b) or (c). The "%" regarding contents of compositions is "mass %".

(a) A steel pipe consisting of C: 0.1 to 0.45%, Si: 0.1 to 1.5%, Mn: 0.1 to 3%, P: 0.03% or less, S: 0.01% or less, sol. Al: 0.05% or less, N: 0.01% or less, Ca: 0 to 0.005%, and the balance Fe and impurities.

(b) A steel pipe consisting of C: 0.1 to 0.45%, Si: 0.1to 1.5%, Mn: 0.1 to 3%, P: 0.03% or less, S: 0.01% or less, sol. Al: 0.05% or less, N: 0.01% or less, Ca: 0 to 0.005%, one or more of Cr: 0.2 to 1.5%, Mo: 0.1 to 0.8% and V: 0.005 to 0.2%, and the balance Fe and impurities.

(c) A steel pipe according to said (a) or (b) containing one or both of Ti 0.005 to 0.05% and Nb: 0.005 to 0.1% in place of a part of Fe.

(3) A method of embedding oil well steel pipes, having smaller diameters one after another, characterized by using the steel pipes according to any one of said (1) or (2) and by comprising the steps of the following (a) to (h);

(a) Embedding a steel pipe in an excavated well, (b) Further excavating the underground on the front end of the embedded steel pipe to deepen the well, (c) Inserting a steel pipe, whose outer diameter is smaller than the inner diameter of the embedded steel pipe, into the embedded steel pipe, and embedding the steel pipe in the deepened portion in the well, (d) Expanding the steel pipe radially by a tool inserted therein to increase the diameter, (e) Further excavating the underground on the front end of the expanded steel pipe to deepen the well, (f) Inserting another steel pipe, whose outer diameter is smaller than the inner diameter of the expanded steel pipe, into the expanded steel pipe, and embedding the steel pipe in the deepened portion of the well, (g) Expanding the steel pipe radially, and (h) Repeating said steps (e), (f) and (g).

1. Prevention of Lowering in Collapse Strength

FIG. 7 is a view for explaining the non-uniform wall thickness ratios. Particularly, FIG. 7(*a*) is a side view of the oil well pipe, and FIG. 7(*b*) is the cross-sectional view. As shown in (a) and (b) of FIG. 7, a cross section at a position in the longitudinal direction is equally divided into 16 parts at the intervals of 22.5°, and wall thickness of the pipe in each of the parts is measured by an ultrasonic method or the like. From the measured results, the maximum pipe wall thickness, the minimum pipe wall thickness and the average pipe wall thickness in its cross section are respectively obtained, and the non-uniform wall thickness ratios (%) are calculated by the following expression ⑤.

Non-uniform wall thickness ratio (%)=[(maximum pipe wall thickness−minimum pipe wall thickness)/average pipe wall thickness]×100 ⑤

Said E0 and E1 are the non-uniform wall thickness ratios obtained by the expression ⑤ with respect to the pipe before expanding and the pipe after expanding respectively. As shown in FIG. 7(*a*), the above-mentioned non-uniform wall thickness ratios in the ten cross sections in intervals of 500 mm from the end of one pipe in the longitudinal direction are obtained. The maximum non-uniform wall thickness ratio of the obtained ratios is defined as the non-uniform wall thickness ratio of the steel pipe.

The above-mentioned expression ① was obtained by the following experiment.

Using seamless steel pipes (corresponding to API-L80 grade) having the chemical composition consisting of, by mass %, C: 0.24%, Si: 0.31%, Mn: 1.35%, P: 0.011% or less, S: 0.003%, sol. Al: 0.035% or less, N: 0.006%, and the balance Fe and impurities, and having outer diameter of 139.7 mm, wall thickness of 10.5 mm and length of 10 m, a pipe expansion test was performed.

Each pipe was expanded in a plug drawing process with a testing machine. Three degrees of expansion ratio, 10%, 20% and 30%, were applied. The expansion ratio means the percentage of the inner diameter increase to the inner diameter of the original pipe.

A distribution of wall thickness of the pipe was measured with an ultrasonic tester (UST) before expanding and after expanding, and non-uniform wall thickness ratios were obtained from the measured distribution of the wall thickness of the pipes. Then the collapse strength of expanded pipe was measured. The collapse strength (PSI) was measured in accordance with RP37 of API standard.

FIG. 5 shows relationships between the non-uniform wall thickness ratios of before and after expanding. As can be seen from FIG. 5, the non-uniform wall thickness ratio of the pipe after expanding is larger than that of the pipe before expanding. Further, as can be seen from FIG. 5, the non-uniform wall thickness ratio of the pipe after expanding is substantially proportional to the non-uniform wall thickness ratio of the pipe before expanding and the coefficient of proportionality is differentiated by the pipe expansion ratio. The relationships (solid lines in FIG. 5) between E1 and E0 of each pipe expansion ratio are expressed by one expression, i.e., the following expression ⑥.

$$E1=(1+0.018\alpha)E0 \quad ⑥$$

Wherein E0 is the non-uniform wall thickness ratio (%) of the pipe before being expanded and E1 is the non-uniform wall thickness ratio (%) of the pipe after being expanded. Accordingly, the non-uniform wall thickness ratio of the expanded pipe can be estimated by the expression ⑥ before expanding of the pipe.

FIG. 6 shows the relationships between "actually measured collapse strength/calculated collapse strength of the expanded pipe without non-uniform wall thickness" and the non-uniform wall thickness ratio of the pipe after being expanded. The relationship was found in the above-mentioned test. The calculated collapse strength (C0) of the expanded pipe without non-uniform wall thickness is a value calculated by the following expression ⑦.

$$C0=2\sigma y[\{(D/t)-1\}/(D/t)^2][1+\{1.47/(D/t)-1\}] \quad ⑦$$

σ y in the expression ⑦ is yield strength (MPa) in the circumferential direction of the pipe, D is an outer diameter (mm) of the expanded pipe and "t" is a wall thickness (mm) of the expanded pipe. The expression ⑦ is described in "Sosei-To-Kakou" (Journal of the Japan Society for Technology of Plasticity) vol. 30, No. 338 (1989), page 385-390.

As apparent from FIG. 6, in the cases of 10% and 20% of the pipe expansion ratios, when a non-uniform wall thickness ratio of the expanded pipe reaches 30% or more, the collapse strength is remarkably lowered, resulting in decrease of 20% or more in comparison with the collapse strength of the pipe without a non-uniform wall thickness. Alternatively, in the case of 30% of the expansion ratio, when a non-uniform wall thickness ratio of the expanded pipe reaches 25% or more, the collapse strength is remarkably lowered, resulting in a decrease of 20% or more in comparison with the collapse strength of the pipe without non-uniform wall thickness.

As described above, the reason for the lowering of collapse strength is the fact that the roundness of the pipe remarkably deteriorates and a synergistic effect of both the non-uniform wall thickness and the deterioration of the roundness lowers the collapse strength, when the non-uniform wall thickness ratio of the expanded pipe exceeds 25% or 30%. Further, in a high pipe expansion ratio of 30% or more, when the non-uniform wall thickness ratio of expanded pipe exceeds 10%, the lowering of collapse strength is remarkably increased. In order to maintain 0.80 or more of the "actually measured collapse strength/collapse strength of the pipe without non-uniform wall thickness", the non-uniform wall thickness ratio of the expanded pipe should be set to 30% or less.

As mentioned above, the non-uniform wall thickness ratio E1 of the expanded pipe can be estimated by expression ⑥. Therefore, conditions to make E1 30% or less are to satisfy the following expression ⑧.

$$E1=(1+0.018\alpha)E0\leqq 30 \quad ⑧$$

From the above expression ⑧ the following expression ① is obtained.

$$E0\leqq 30/(1+0.018\alpha) \quad ①$$

As apparent from FIG. 6, a smaller value of E1 is preferable. Thus, E0 preferably satisfies the following expression ①-1 and more preferably satisfies the following expression ①-2.

$$E0\leqq 25/(1+0.018\alpha) \quad ①\text{-}1$$

$$E0\leqq 10/(1+0.018\alpha) \quad ①\text{-}2$$

2. Prevention of Bending of Pipe Due to Expansion

In order to find the relationships between the non-uniform thickness wall of the steel pipe and bending of the expanded pipe in detail, shapes of non-uniform wall thickness of the steel pipe before expansion have been investigated. Since a steel pipe is produced through many steps, various non-uniform wall thicknesses will be produced in the respective steps. As illustrated in FIG. 8(*b*), in addition to non-uniform wall thickness of a 360 degrees cycle (the first order of the non-uniform wall thickness), there are non-uniform wall thickness of 180 degrees cycle (the second order of the non-uniform wall thickness), non-uniform wall thickness of 120 degrees cycle (the third order of the non-uniform wall thickness), non-uniform wall thickness of 90 degrees cycle (the fourth order of the non-uniform wall thickness), and non-uniform wall thickness of 60 degrees cycle (the sixth order of the non-uniform wall thickness). These non-uniform wall thicknesses of the steel pipe can be expressed by a mathematical expression using a sine curve function.

As shown in FIG. 8(*a*), the above mentioned non-uniform wall thicknesses overlap on an actual cross-section of a steel pipe. In other words the actual non-uniform wall thickness of a steel pipe is a sum of the various orders of the non-uniform wall thicknesses, which are expressed by sine curves. Therefore, in order to find an mount of the k-th order of the non-uniform wall thickness of the pipe, thicknesses of cross-sections of the pipe are measured at constant intervals and the obtained wall thickness profiles is computed by Fourier-transform in accordance with the following expression ⑨. Here, the amount of the k-th order of the non-uniform wall thickness of the pipe is defined as a difference between the maximum non-uniform wall thickness in the k-th order of the non-uniform thickness component and the minimum non-uniform wall thickness in the k-th order of the non-uniform thickness component.

K-th order of the non-uniform thickness component $$G(k) = 4\sqrt{R^2(k) + I^2(k)} \quad ⑨$$

$$R(k) = \frac{1}{N}\sum_{i=1}^{N}\{WT(i)\cdot\cos(2\pi/N\cdot k\cdot(i-1))\}$$

$$I(k) = -\frac{1}{N}\sum_{i=1}^{N}\{WT(i)\cdot\sin(2\pi/N\cdot k\cdot(i-1))\}$$

Wherein N is a number of measured wall thickness points in cross-section of the pipe, and WT(i) is measured wall thickness profiles, in which i=1, 2, . . . , N.

As explained in the [Example 2] described later, the relationships between a non-uniform wall thickness ratio of the steel pipe and bending generated by expanding was investigated. Then, the non-uniform thicknesses of non-expanded steel pipe were separated to the respective orders of the non-uniform wall thicknesses, and influences of the respective non-uniform wall thickness ratios on bending of expanded pipe were recognized. As a result, the relationships as shown in FIGS. 9, 10 and 11 were found. These drawings show relationships between an eccentric non-uniform wall thickness ratio of non-expanded steel pipe and an amount of bending described by "1/radius of curvature" of expanded steel pipe. As apparent from FIGS. 10 and 11, among the originally existing non-uniform wall thicknesses of the pipe, the second or posterior orders of the non-uniform wall thicknesses have a small effect on the bending of the steel pipe. On the other hand, as shown in FIG. 9, the eccentric non-uniform wall thicknesses shown in FIG. 8(*b*), that is the first order of the non-uniform wall thickness, promotes the most bending of the expanded pipe.

The eccentric non-uniform wall thickness (the first order of the non-uniform wall thickness) of the steel pipe is generated in the production process of steel pipe when, for example, a plug, which is a piercing tool of a piercer, is applied to a position shifted from the center of the cylindrical billet during piercing. As mentioned above, the eccentric non-uniform wall thickness is a non-uniform wall thickness in which a thin wall thickness portion and a thick wall thickness portion exist at a cycle of 360 degrees respectively. Accordingly, the eccentric non-uniform wall thickness ratio (%) can be defined by the following expression (10).

$$\text{Eccentric non-uniform wall thickness ratio}=\{(\text{maximum wall thickness in eccentric non-uniform component}-\text{minimum wall thickness in eccentric non-uniform component})/\text{average wall thickness}\}\times 100 \quad (10)$$

As shown in FIG. 9, the larger the eccentric non-uniform wall thickness ratio is, the larger "1/radius of curvature" becomes, that is, the bending becomes larger. When the steel pipe is used for an oil well pipe, the "1/radius of curvature" must be 0.00015 or less to ensure the reliability of threaded portions, and 0.0001 or less is preferable. 0.00005 or less is more preferable. As can be seen from FIG. 9, the steel pipe may be used for an oil well pipe if its eccentric non-uniform wall thickness ratio of non-expanded steel pipe is 10% or less, preferably 8% or less, and more preferably 5% or less, even if the steel pipe is expanded with the expansion ratio of 30%.

As described above, the steel pipe of the present invention has been explained while separating the non-uniform wall thickness ratio and the eccentric non-uniform wall thickness from each other. The non-uniform wall thickness ratio can be obtained by the maximum wall thickness and the minimum wall thickness in a cross section of actual pipe shown in FIG. 8(*a*). On the other hand, the eccentric non-uniform wall thickness ratio is a non-uniform wall thickness ratio in the one direction wall thickness shown in FIG. 8(*b*). Accordingly, if the condition wherein the first order of the non-uniform wall thickness ratio satisfies said expression (1) or the condition wherein the eccentric non-uniform wall thickness ratio is 10% or less is satisfied, it is preferable to use this steel pipe. If the pipe satisfies both conditions, this expanded steel pipe has high collapse strength and small bending.

3. Method of Embedding Steel Pipe

The embedding method according to the present invention is characterized by using the above-described steel pipe of the present invention. Specifically it is an embedding method comprising the following steps of:

1) Embedding a steel pipe in an excavated well, further excavating the underground on the front end of the embedded steel pipe to deepen the well, inserting the second steel pipe, whose outer diameter is smaller than the inner diameter of the embedded steel pipe, in the embedded steel pipe to embed the second steel pipe in the deepened portion of the well;

2) Expanding the second steel pipe radially by a tool inserted in it in order to increase the diameter of the second steel pipe, further excavating the underground on the front end of the second expanded steel pipe to deepen the well, inserting the third steel pipe, whose outer diameter is smaller than the inner diameter of the second expanded steel pipe, in the second expanded steel pipe to embed the third steel pipe in the deepened portion of the well;

3) Repeating the above-mentioned embedding and expanding of the pipe to embed steel pipes having smaller diameters sequentially.

In the above-mentioned process, the steel pipe of the present invention can be used as the steel pipe for expanding. Various methods can be used for the expanding work, such as pulling up a plug or a tapered mandrel by hydraulically or mechanically.

BEST MODE FOR CARRYING OUT THE PREFERRED EMBODIMENT

Embodiments of the present invention will be described in detail.

In the method according to the present invention, the reason why the steel pipe, having an outer diameter smaller than an inner diameter of embedded steel pipe, is inserted into the embedded pipe and is expanded is that, as described above, a space between the previously embedded steel pipe and the subsequently inserted steel pipe is reduced so that the excavating area for embedding oil well pipes is reduced.

Figure 1:
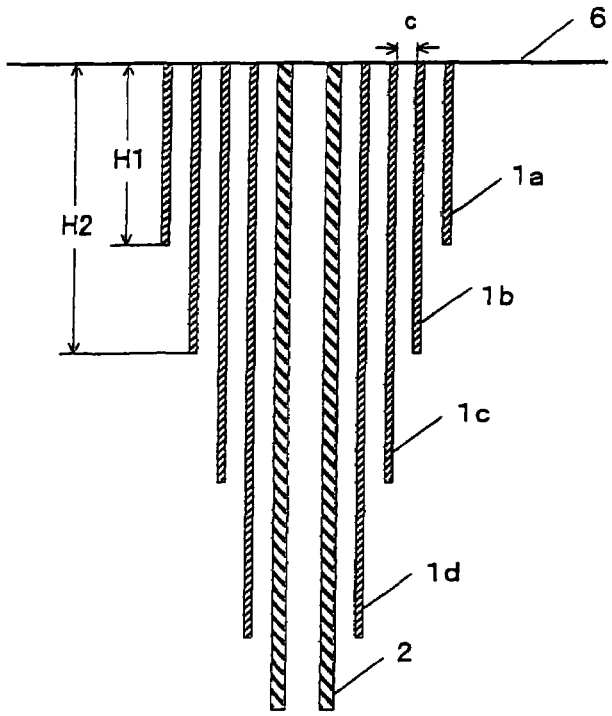
FIG. 1 is a view explaining the conventional method of excavating an oil well.
Figure 2:
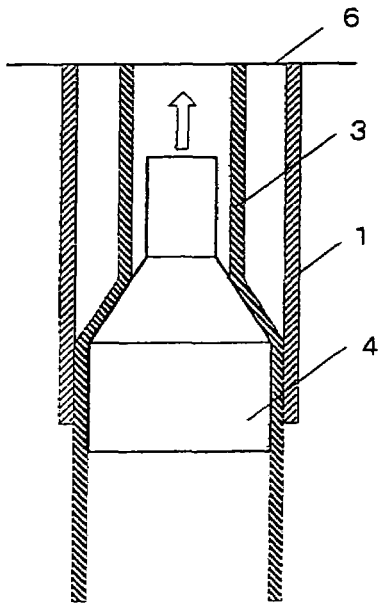
PRIOR ART Fig. 2
FIG. 2 is a view explaining a method of excavating an oil well by the expanding method.
Figure 3:
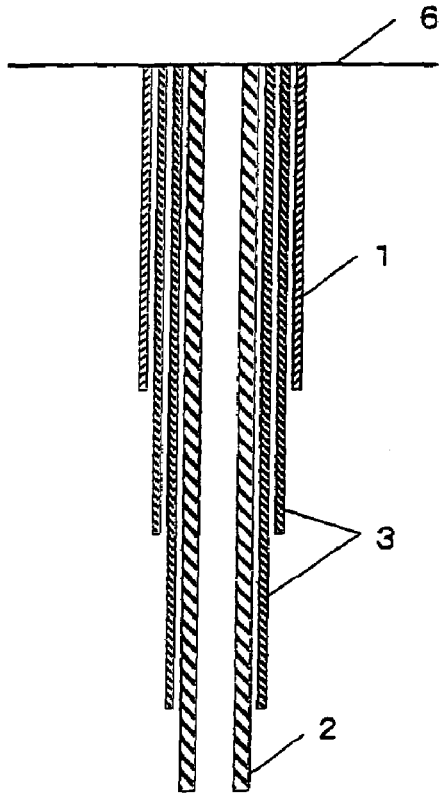
FIG. 3 is a view showing an oil well pipe embedded by the expanding method.

Means for expanding the steel pipe to increase the diameter thereof is not limited. However, the most preferable means is one in which a tapered tool (plug) is inserted into the pipe, as shown in FIG. 2, and pressure is applied by injecting oil from the lower end of the pipe in order to push up the tool by oil pressure whereby the pipe expands. Alternatively, mechanically drawing the tool can also be used.

In this case, it is important to use the steel pipe according to the present invention as the oil well pipe for expanding. By using the steel pipe according to the present invention the lowering of collapse strength of the expanded steel pipe and its bending can be suppressed.

It is not necessary to expand all pipes to be a casing. Even if only one or two sizes casing steel pipe may be expanded, there is an reducing effect in the oil field excavating area. Preparation of various kinds of expanding tools and an increase in the pipe expansion operation are needed to expand all sizes of steel pipe. Thus, steel pipes to be expanded may be limited when taking the required costs into consideration.

The steel pipe, according to the present invention, can be used not only in developing a new oil field but also in repairing an existing oil well. When a part of a casing is broken or corroded, repairing can be performed by pulling the casing up and inserting and expanding substitute steel pipes.

The steel pipe of the present invention may be an electric resistance welded steel pipe (ERW steel pipe) and a seamless steel pipe produced from a billet. Alternatively, steel pipes subjected to heat treatment such as quenching, tempering and the like and straightening treatment such as cold drawing may be used. The chemical compositions are not limited at all. For example, low alloy steels such as C—Mn steel, Cr—Mo steel, 13Cr steel, ferritic stainless steel, high Ni steel, martensitic stainless steel, duplex stainless steel and austenitic stainless steel or the like may be used.

The above-mentioned steel pipes (a), (b) and (c) are desirable examples. Effects and contents of the respective components in the desirable steel pipe will be described below.

C:

C (Carbon) is an essential element to ensure the strength of the steel and obtain sufficient quenching properties. To obtain these effects the content of C is preferably 0.1% or more. When the content of C is less than 0.1%, tempering at a low temperature is needed to obtain required strength. Thus a sensibility to sulfide stress corrosion cracking (hereafter referred to as SSC) is undesirably increased. On the other hand, when the content of C exceeds 0.45%, the sensibility to quenching crack is increased and ductility is also deteriorated. Therefore, the content of C is preferably in a range of 0.1 to 0.45%. The more preferable range is 0.15 to 0.3%.

Si:

Si (Silicon) has effects of acting as a deoxidizer for steel and increasing its strength by enhancing temper-softening resistance. When the content of Si is less than 0.1%, these desired effects cannot be sufficiently obtained. On the other hand, when the content of Si exceeds 1.5%, hot workability of the steel is remarkably deteriorated. Accordingly, the content of Si is preferably in a range of 0.1 to 1.5%. The more preferable range is 0.2 to 1%.

Mn:

Mn (Manganese) is an effective element for increasing hardenability of steel to ensure the strength of the steel pipe. When the content of Mn is less than 0.1%, the desired effects cannot be sufficiently obtained. On the other hand, when the content of Mn exceeds 3%, its segregation is increased and the ductility of the steel is deteriorated. Accordingly, the content of Mn is preferably in a range of 0.1 to 3%. The more preferable range is 0.3 to 1.5%.

P:

P (Phosphorus) is an element, which is contained in steel as an impurity. When the content of P exceeds 0.03%, it segregates at grain boundaries thereby reducing the ductility of the steel. Accordingly, the content of P is preferably 0.03% or less. The smaller the P content the better, and the more preferable range of the P content is 0.015%.

S:

S (Sulfur) is an element, which is contained in steel as an impurity. It forms sulfide inclusions with Mn, Ca and the like. Since S deteriorates the ductility of the steel, the smaller the content of S the better. When the content of S exceeds 0.01%, the deterioration of ductility becomes significant. Accordingly, the content of S is preferably 0.01% or less. The more preferable range of the S content is 0.005% or less.

sol. Al:

Al (Aluminum) is an element used as a deoxidizer for steel. When the content of sol. Al exceeds 0.05%, a deoxidation effect saturates and the ductility of the steel is reduced. Therefore, the content of sol. Al is preferably 0.05% or less. It is not necessary to have the sol. Al substantially contained in the steel. However, to obtain the above-mentioned effects sufficiently, the content of sol. Al is preferably 0.01% or more.

N:

N (Nitrogen) is an element, which is contained in steel as an impurity. It forms nitrides together with elements such as Al, Ti and the like. Particularly, when a large amount of AlN or TiN is precipitated, ductility of the steel is deteriorated. Thus, N content is preferably 0.01% or less. The smaller the content of N the better. The more preferable range is 0.008% or less.

Ca:

Ca (Calcium) is an element that may be optionally contained, and is effective in order to improve ductility by changing the shape of sulfide in the steel. Therefore, when the ductility of the steel pipe is particularly important, Ca may be contained in the steel. Ca is preferably contained by 0.001% or more in order to obtain said effects sufficiently. On the other hand, when Ca content exceeds 0.005%, a large amount of inclusions is produced. The inclusions become starting points of pitting and deteriorate the corrosion resistance of the steel. Therefore, when Ca is contained, the content of Ca is preferably in a range of 0.001 to 0.005%. The more preferable range is 0.002 to 0.004%.

The oil well pipe, having the above-mentioned chemical composition, may contain one or more of the elements selected from Cr, Mo and V in order to enhance strength. Further, either one or both of Ti and Nb may be contained in order to prevent coarsening of grains at a high temperature and to ensure the ductility of the steel. Preferable ranges of content of the respective elements will be described below.

One or more of Cr, Mo and V:

These elements are effective for enhancing hardenability of the steel to increase the strength thereof when suitable amounts of them are contained in the steel. In order to obtain these effects, one or more of the above-mentioned elements are preferably contained in the following range of contents. On the other hand, when the contents exceed suitable amounts, these elements each are liable to form coarse carbide and often deteriorate ductility or corrosion resistance of the steel.

Cr is effective, in addition to the above-mentioned effects, in reducing the corrosion rate in high temperature carbon dioxide gas environments. Further, Mo has an effect of suppressing segregation of P or the like at grain boundaries and V has an effect of enhancing temper-softening resistance.

Cr: 0.2 to 1.5%; More preferable range is 0.3 to 1%.

Mo: 0.1-0.8%; More preferable range is 0.3 to 0.7%.

V: 0.005-0.2%; More preferable range is 0.008 to 0.1%.

Ti and Nb:

Ti (Titanium) or Nb (Niobium) forms TiN or NbC when they are contained in a suitable amount, respectively, so that they prevent coarsening of grains and improve ductility of the steel. When the effect of preventing the coarsening of grains is required, one or two of these elements may contain in the following ranges of contents. When the content exceeds the suitable amount, an amount of TiC or NbC becomes excessive and the ductility of steel is deteriorated.

Ti: 0.005 to 0.05%; More preferable range is 0.009 to 0.03%.

Nb: 0.005 to 0.1%; More preferable range is 0.009 to 0.07%.

EXAMPLES

Example 1

Four kinds of steels, having chemical compositions shown in Table 1, were prepared, and seamless steel pipes having an outer diameter of 139.7 mm, a wall thickness of 10.5 mm and a length of 10 m were produced in the usual Mannesmann-mandrel pipe production process. Then, the steel pipes were subjected to- heat treatment of quenching-tempering to make them products corresponding to API-L80 grade (yield strength: 570 MPa).

Non-uniform wall thickness ratios of non-expanded steel pipes of Steel A, Steel B and Steel C were measured by UST. After that the steel pipes were expanded by mechanical drawings with a plug inserted in the pipe. The pipe expansion ratios were three degrees of 10%, 20% and 30% as a magnification ratio on the inner diameter of the pipe.

Figure 4:
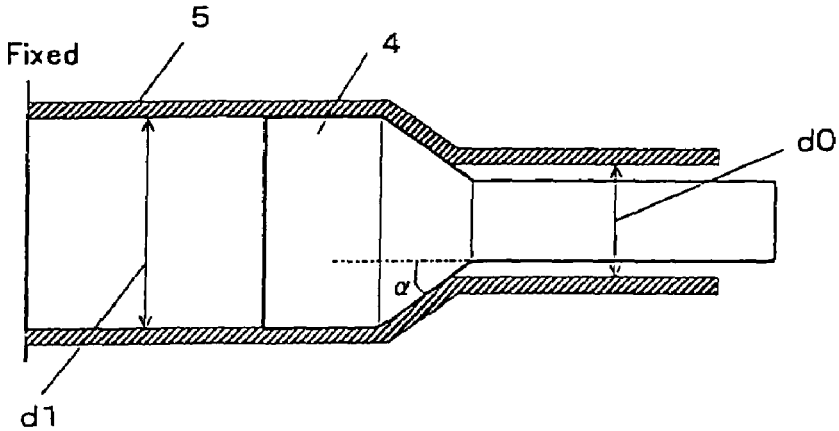
PRIOR ART Fig. 4
FIG. 4 is a longitudinal sectional view showing an aspect of the pipe expanding.
Figure 5:
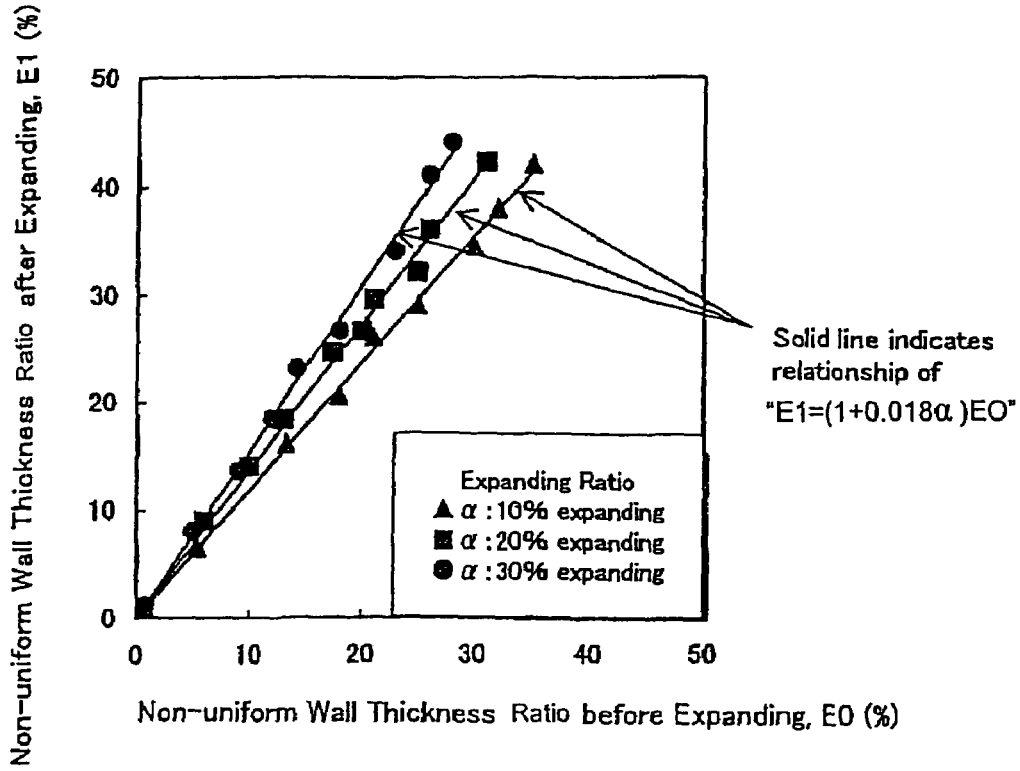
FIG. 5 is a view showing the relationships between a non-uniform wall thickness ratio of the steel pipe before expanding and a non-uniform thickness ratio of the expanded steel pipe obtained by tests.
Figure 6:
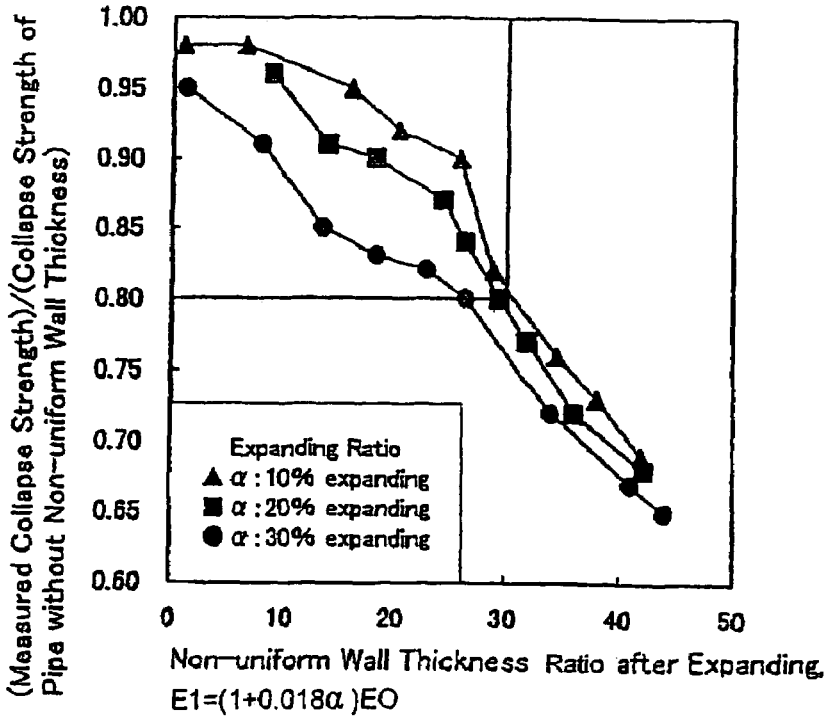
FIG. 6 is a view showing the relationships between a non-uniform thickness ratio of expanded steel pipe and lowering of collapse strength.

FIG. 4 is a cross-sectional view of a plug periphery during the expansion of the pipe. As shown in FIG. 4, the pipe 5 was expanded by fixing an end of the expansion starting side and mechanical drawing of the plug 4. A tapered angle α at the front end of the plug was set to 20 degrees. The pipe expansion ratio was obtained by said expression ②. Using the marks in FIG. 4, the pipe expansion ratio is expressed as follows.

$$\text{Pipe expansion ratio}=[(\text{inner diameter } d1 \text{ of the pipe after expanding}-\text{inner diameter } d0 \text{ of the pipe before expanding})/d0]\times 100$$

Wall thickness distributions of the steel pipes before expanding and after expanding were determined by UST. The non-uniform wall thickness ratios were obtained from the measured wall thicknesses of the pipes. Collapse strength of the steel pipe after expanding was determined in accordance with RP37 of the API standard. As described in FIG. 7 the measurement of non-uniform wall thickness was performed at 16 points at the intervals of 22.5 degrees with respect to every 10 cross sections at 500 mm pitches in the longitudinal direction of the pipe. The maximum non-uniform wall thickness ratios in their measured results are shown in Table 2. "C1/C0 " in Table 2 is a ratio of the actually measured collapse strength (C1) of the steel pipe after expanding to collapse strength (C0) of steel pipe without non-uniform wall thickness calculated by said expression ⑦.

As apparent from Table 2, in the examples of the present invention, which satisfy the expression ①, that is $E0 \leqq 30/(1+0.018\alpha)$, collapse strengths in all the pipe expansion ratios were high and the ratios of C1/C0 were 0.8 or more. On the other hand, in comparative examples of the expanded steel pipe having non-uniform wall thickness ratios, which do not satisfy the expression ①, the collapse strengths were low in all pipe expansion ratios and the ratios of C1/C0 were less than 0.8.

TABLE 1

| | Chemical Composition (mass %, bal.: Fe and impurities) | | | | | | | | | | | |
|---|---|---|---|---|---|---|---|---|---|---|---|---|
| Steel | C | Si | Mn | P | S | sol.Al | N | Cr | Mo | V | Ti | Nb |
| A | 0.24 | 0.31 | 1.35 | 0.011 | 0.003 | 0.035 | 0.006 | — | — | — | 0.010 | — |
| B | 0.25 | 0.23 | 0.44 | 0.005 | 0.001 | 0.013 | 0.008 | 1.01 | 0.7 | 0.01 | 0.011 | — |
| C | 0.12 | 0.36 | 1.27 | 0.014 | 0.001 | 0.040 | 0.009 | — | — | 0.01 | 0.021 | 0.021 |
| D | 0.24 | 0.35 | 1.30 | 0.011 | 0.002 | 0.033 | 0.006 | 0.20 | — | 0.01 | 0.010 | — |

TABLE 2

| Steel | Expanding Ratio (α) % | Non-uniform Wall Thickness Ratio before Expanding (E0) % | Non-uniform Wall Thickness Ratio after Expanding (E1) % | 30/(1 + 0.018 α) | Measured Collapse Strength (C1) psi | C1/C0 | Note |
|---|---|---|---|---|---|---|---|
| A | 10 | 5.4 | 6.5 | 25.4 | 11200 | 0.98 | ○ |
| | 10 | 25.0 | 29.0 | 25.4 | 9500 | 0.82 | ○ |
| | 10 | 30.0 | 34.5 | 25.4 | 8800 | 0.76 | X |
| | 20 | 10.0 | 14.0 | 22.1 | 9150 | 0.91 | ○ |
| | 20 | 17.4 | 24.5 | 22.1 | 8750 | 0.87 | ○ |
| | 20 | 25.0 | 32.0 | 22.1 | 7700 | 0.77 | X |
| | 30 | 0.8 | 1.2 | 19.5 | 8100 | 0.95 | ○ |
| | 30 | 9.0 | 13.6 | 19.5 | 7250 | 0.85 | ○ |
| | 30 | 23.0 | 34.0 | 19.5 | 6100 | 0.72 | X |
| B | 10 | 0.8 | 1.0 | 25.4 | 12800 | 0.98 | ○ |
| | 10 | 13.3 | 16.1 | 25.4 | 12400 | 0.95 | ○ |
| | 10 | 32.0 | 38.0 | 25.4 | 9600 | 0.73 | X |
| | 20 | 6.0 | 9.0 | 22.1 | 10800 | 0.96 | ○ |
| | 20 | 20.0 | 26.5 | 22.1 | 9500 | 0.84 | ○ |
| | 20 | 26.0 | 36.0 | 22.1 | 8160 | 0.72 | X |

TABLE 2-continued

| Steel | Expanding Ratio (α) % | Non-uniform Wall Thickness Ratio before Expanding (E0) % | Non-uniform Wall Thickness Ratio after Expanding (E1) % | 30/(1 + 0.018 α) | Measured Collapse Strength (C1) psi | C1/C0 | Note |
|---|---|---|---|---|---|---|---|
| | 30 | 12.0 | 18.4 | 19.5 | 9200 | 0.83 | ○ |
| | 30 | 14.2 | 23.0 | 19.5 | 7800 | 0.82 | ○ |
| | 30 | 26.0 | 41.0 | 19.5 | 6500 | 0.67 | X |
| C | 10 | 18.0 | 20.5 | 25.4 | 8000 | 0.92 | ○ |
| | 10 | 21.0 | 26.0 | 25.4 | 7800 | 0.90 | ○ |
| | 10 | 35.0 | 42.0 | 25.4 | 6050 | 0.69 | X |
| | 20 | 13.1 | 18.3 | 22.1 | 6750 | 0.90 | ○ |
| | 20 | 21.0 | 29.5 | 22.1 | 6000 | 0.80 | ○ |
| | 20 | 31.0 | 42.2 | 22.1 | 5100 | 0.68 | X |
| | 30 | 5.0 | 8.0 | 19.5 | 5800 | 0.91 | ○ |
| | 30 | 18.0 | 26.5 | 19.5 | 5100 | 0.80 | ○ |
| | 30 | 28.0 | 44.0 | 19.5 | 4100 | 0.65 | X |

Note:
C1 is collapse strength of the pipe after expanding.
C0 is calculated collapse strength of the pipe without non-uniform wall thickness.
Mark "○" in Note means an example of the present invention.
Mark "X" in Note means a comparative example.

Example 2

Using the Steel D in Table 1, a seamless steel pipe having an outer diameter of 139.7 mm, a wall thickness of 10.5 mm and a length of 10 m was produced by the same method as in the Example 1, and subjected to heat treatment of quenching-tempering. The obtained pipe is a product corresponding to API-L80 grade.

Figure 7:
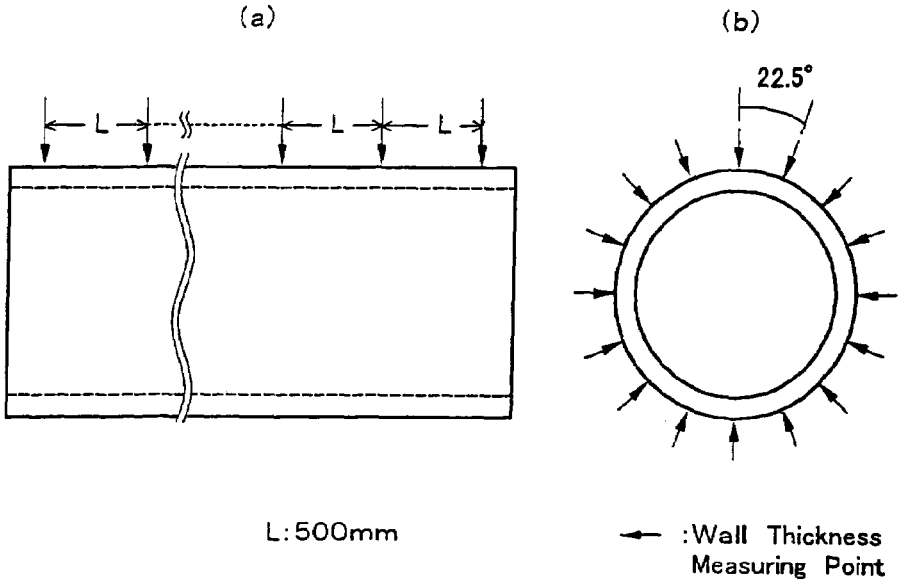
FIG. 7 is a view showing positions for measuring pipe wall thicknesses for finding the non-uniform wall thickness ratios.
Figure 8:
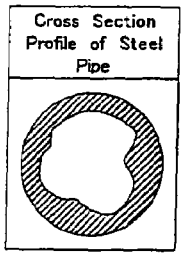
FIG. 8 is a cross-sectional view explaining forms of steel pipe wall thicknesses.
Figure 8:
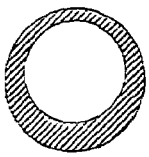
Figure 8:
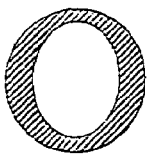
Figure 8:
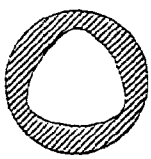
Figure 8:
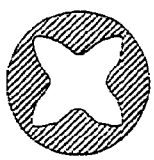
Figure 8:
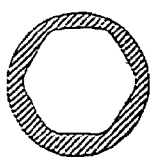

The non-uniform wall thickness profile of the steel pipe, before expanding, was investigated by UST. As shown in FIG. 7, the non-uniform wall thickness profile was obtained by measuring wall thickness at 16 points equally divided in the circumferential direction of the pipe with respect to every 10 cross sections at 500 mm pitches in the longitudinal direction of the pipe. From the wall thickness profile, the components of the eccentric non-uniform wall thickness (the first order of the non-uniform wall thickness), the second order of the non-uniform wall thickness and the third order of the non-uniform wall thickness were extracted by the Fourier analysis to obtain the non-uniform thickness ratios of the respective components. The results are shown in Table 3. "Measuring No." in Table 3 is a number of a measuring point in the longitudinal direction of the pipe.

Using the above-mentioned pipe, pipe expansion was performed by the same method as in Example 1. The pipe expansion ratios were 10%, 20% and 30%.

A curvature radius of the expanded steel pipe was measured at a position (measuring No.1 in Table 3) where the eccentric non-uniform wall thickness ratio in the longitudinal direction of the pipe was maximum. Curvature radii of other positions were also measured. However, the values of the radii were so large that the bending had no actual disadvantage.

Figure 9:
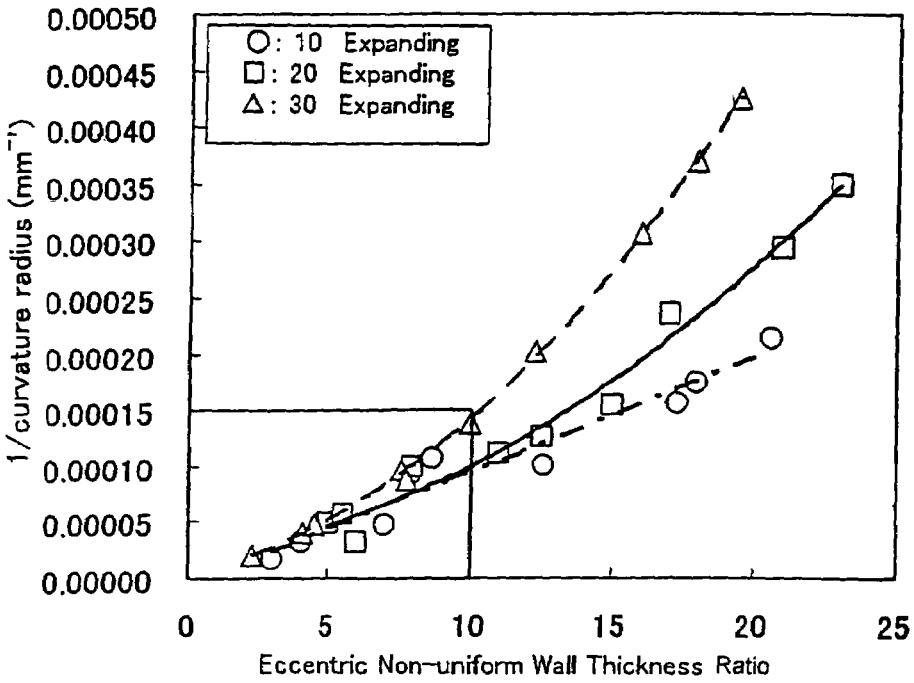
FIG. 9 is a view showing the relationships between eccentric non-uniform wall thickness (the first order of the non-uniform wall thickness ratio) of the steel pipe before expanding and an amount of bending of the expanded steel pipe.
Figure 10:
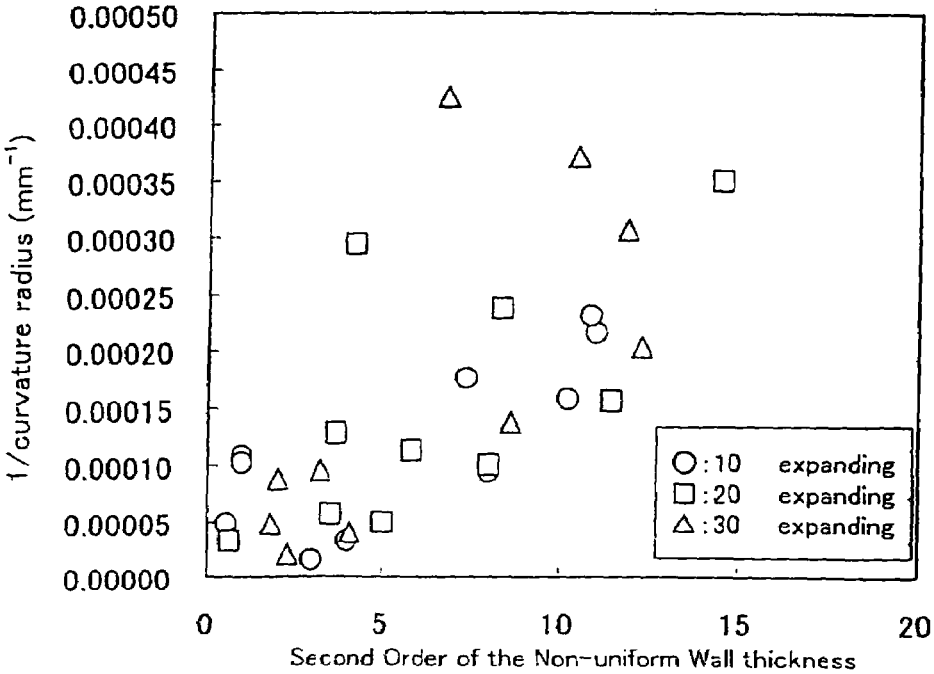
FIG. 10 is a view showing the relationships between the second order of the non-uniform wall thickness of the steel pipe before expanding and an amount of bending of the expanded steel pipe.
Figure 11:
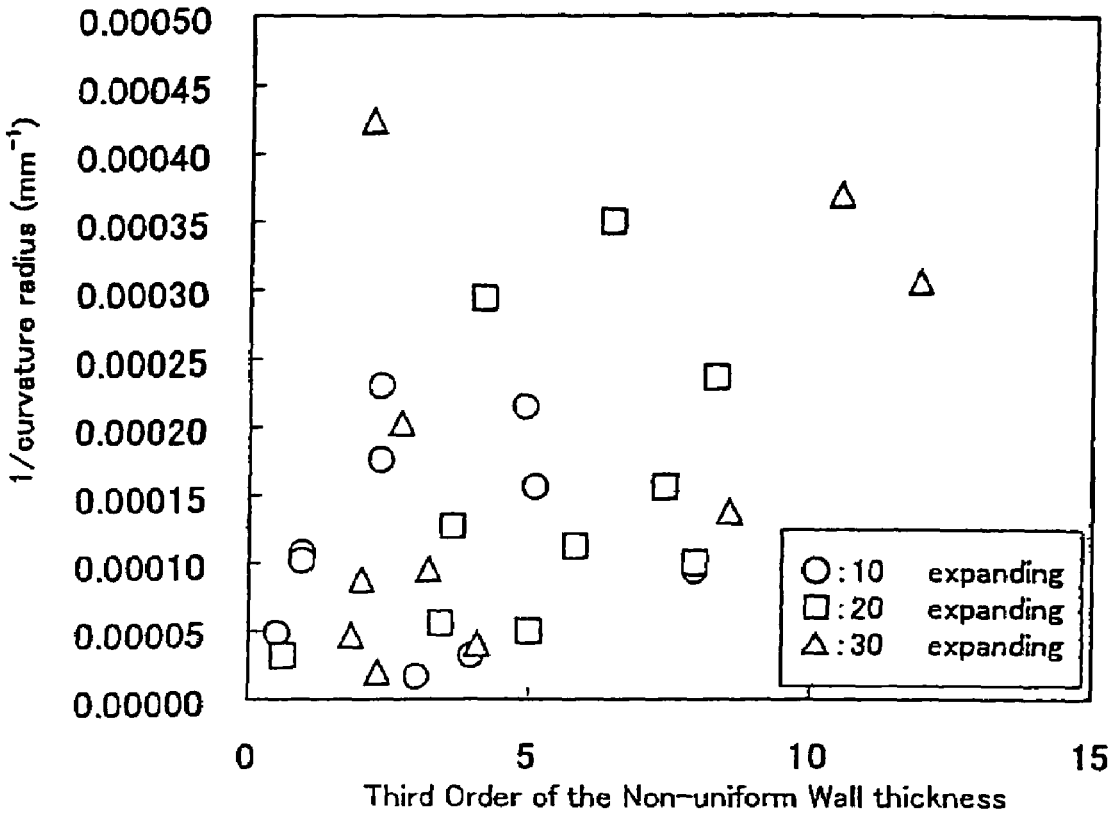
FIG. 11 is a view showing the relationships between the third order of the non-uniform wall thickness of the steel pipe before expanding and an amount of bending of the expanded steel pipe.

FIG. 9, FIG. 10 and FIG. 11 respectively show relationships between the reciprocal of the curvature radius of the expanded pipe and the non-uniform wall thickness ratios of the first order of the non-uniform wall thickness (the eccentric non-uniform wall thickness), the second order of the non-uniform wall thickness and the third order of the non-uniform wall thickness of the pipe. As shown in FIG. 9, in the pipe whose eccentric non-uniform wall thickness ratio exceeds 10%, bending due to the expansion is remarkably large. As shown in FIGS. 10 and 11, the relationships between the second order or the third order non-eccentric non-uniform wall thickness and amounts of bending are small. As described above, it can be understood that to suppress the

TABLE 3

| | Average | First Order of the Non-uniform Wall Thickness (Eccentric Non-uniform Wall Thickness) | | Second Order of the Non-uniform Wall Thickness | | Third Order of the Non-uniform Wall Thickness | |
|---|---|---|---|---|---|---|---|
| Measuring No. | Wall Thickness (mm) | Non-uniform Wall Thickness (mm) | Non-uniform Wall Thickness Ratio (%) | Non-uniform Wall Thickness (mm) | Non-uniform Wall Thickness Ratio (%) | Non-uniform Wall Thickness (mm) | Non-uniform Wall Thickness Ratio (%) |
| 1 | 10.56 | 0.57 | 5.4 | 0.37 | 3.5 | 0.36 | 3.4 |
| 2 | 10.58 | 0.42 | 4.0 | 0.03 | 0.3 | 0.36 | 3.4 |
| 3 | 10.52 | 0.41 | 3.9 | 0.05 | 0.5 | 0.31 | 2.9 |
| 4 | 10.51 | 0.32 | 3.0 | 0.15 | 1.4 | 0.33 | 3.1 |
| 5 | 10.45 | 0.45 | 4.3 | 0.09 | 0.9 | 0.25 | 2.4 |
| 6 | 10.43 | 0.33 | 3.2 | 0.07 | 0.7 | 0.28 | 2.7 |
| 7 | 10.37 | 0.46 | 4.4 | 0.10 | 0.9 | 0.31 | 2.9 |
| 8 | 10.44 | 0.50 | 4.8 | 0.12 | 1.1 | 0.33 | 3.1 |
| 9 | 10.54 | 0.51 | 4.8 | 0.14 | 1.3 | 0.29 | 2.7 |
| 10 | 10.43 | 0.48 | 4.6 | 0.08 | 0.8 | 0.29 | 2.7 |

eccentric non-uniform wall thickness ratio of the pipe to 10% or less is important in order to prevent the bending of expanded pipe.

INDUSTRIAL APPLICABILITY

The steel pipe according to the present invention has high collapse strength even after being expanded. Further, bending due to the expansion of the pipe is small. By using this steel pipe in the embedding-expanding method, remarkable effects of reducing a well excavation area and enhancing reliability of the oil well pipe can be obtained.

The invention claimed is:

1. A method of embedding oil well steel pipes having smaller diameters one after another comprising:

selecting a steel pipe to be expanded in a well as part of the embedding method, wherein the selected steel pipe has an eccentric non-uniform wall thickness ratio of 10% or less, and embedding a steel pipe in an excavated well, further excavating the underground on the front end of the embedded steel pipe to deepen the well, inserting a second steel pipe, whose outer diameter is smaller than the inner diameter of the embedded steel pipe, into the embedded steel pipe, and embedding the second steel pipe in the deepened portion of the well, expanding the second steel pipe radially by a tool inserted therein to increase the diameter, further excavating the underground on the front end of the expanded steel pipe to deepen the well, inserting another third steel pipe, whose outer diameter is smaller than the inner diameter of the expanded steel pipe, into the expanded steel pipe, and embedding the third steel pipe in the deepened portion of the well, expanding the third steel pipe radially, and repeating said steps;

wherein the second and third steel pipes are the selected steel pipes and using the selected steel pipes as the second and third steel pipes improves resistance to bending during the expanding steps.

2. The method according claim 1 characterized by using a steel pipe comprising, by mass %, C: 0.1 to 0.45%, Si: 0.1 to 1.5%, Mn: 0.1 to 3%, P: 0.03% or less, S: 0.01% or less, sol.Al: 0.05% or less, N: 0.01% or less, Ca: 0 to 0.005%, and the balance Fe and impurities.

3. The method according claim 1 characterized by using a steel pipe comprising, by mass %, C: 0.1 to 0.45%, Si: 0.1 to 1.5%, Mn: 0.1 to 3%, P: 0.03% or less, S: 0.01% or less, sol.Al: 0.05% or less, N: 0.01% or less, Ca: 0 to 0.005%, one or more of Cr: 0.2 to 1.5%, Mo: 0.1 to 0.8% and V: 0.005 to 0.2%, and the balance Fe and impurities.

4. The method according claim 1 characterized by using a steel pipe comprising, by mass %, C: 0.1 to 0.45%, Si: 0.1 to 1.5%, Mn: 0.1 to 3%, P: 0.03% or less, S: 0.01% or less, sol.Al: 0.05% or less, N: 0.01% or less, Ca: 0 to 0.005%, one or both of Ti: 0.005 to 0.05% and Nb: 0.005 to 0.1%, and the balance Fe and impurities.

5. The method according claim 1 characterized by using a steel pipe comprising, by mass %, C: 0.1 to 0.45%, Si: 0.1 to 1.5%, Mn: 0.1 to 3%, P: 0.03% or less, S: 0.01% or less, sol.Al: 0.05% or less, N: 0.01% or less, Ca: 0 to 0.005%, one or more of Cr: 0.2 to 1.5%, Mo: 0.1 to 0.8% and V: 0.005 to 0.2%, one or both of Ti: 0.005 to 0.05% and Nb: 0.005 to 0.1%, and the balance Fe and impurities.

* * * * *